United States Patent [19]

Mori et al.

[11] Patent Number: 4,540,081

[45] Date of Patent: Sep. 10, 1985

[54] BILL ACCEPTING DEVICE AND METHOD FOR CONTROLLING ACCEPTING OF BILLS

[75] Inventors: Yoshikazu Mori, Saitama; Osamu Kobayashi, Sakado, both of Japan

[73] Assignee: Kabushiki Kaisha Nippon Coinco, Tokyo, Japan

[21] Appl. No.: 514,185

[22] Filed: Jul. 15, 1983

[30] Foreign Application Priority Data

Jul. 20, 1982 [JP] Japan ..... 57-125020

[51] Int. Cl.[3] ..... G07F 7/04

[52] U.S. Cl. ..... 194/4 C; 209/534

[58] Field of Search ..... 194/4 R, 4 C; 209/534; 414/69; 271/3

[56] References Cited

U.S. PATENT DOCUMENTS 4,011,931 3/1977 Wyckoff ..... 194/4 C 4,337,864 7/1982 McLean ..... 194/4 R

*Primary Examiner*—Stanley H. Tollberg

*Attorney, Agent, or Firm*—Spensley, Horn, Jubas & Lubitz

[57] ABSTRACT

This bill accepting device comprises a bill discrimination section for discriminating whether an inserted bill is true or not, an escrow section capable of retaining a bill accepted by the bill discrimination section as a true bill and returning the retained bill and a stocker section provided between the bill discrimination section and the escrow section, including a bill conveying passage connecting the bill discrimination section and the escrow section and receiving a bill being present in the bill conveying passage in a predetermined accumulating location by moving the bill in a direction in which the bill crosses the bill conveying passage. The inserted bill is led to a linear passage in the stocker section through the bill discrimination section. By performing a control operation so as to either carry the bill present in this linear passage to the escrow section or move the bill in a direction in which it crosses the passage, the bill is received in either the escrow section or an accumulating location in the stocker section.

11 Claims, 13 Drawing Figures

BILL ACCEPTING DEVICE AND METHOD FOR CONTROLLING ACCEPTING OF BILLS

BACKGROUND OF THE INVENTION

This invention relates to a bill accepting device employed in a vending machine and a bill exchanging machine and also to a method for controlling accepting of bills.

A bill accepting device comprises at least a bill discrimination device having a function of discriminating a true bill from a false one among inserted bills and accepting a true bill and returning a false one and a receiving device for receiving accepted bills. For returning a once accepted bill when required, the receiving device must be composed of a temporary retention device, i.e., escrow device and, in this case, the escrow device must have a further storing device, i.e., stocker device for storing bills which have exceeded a number which can be received. The specification of U.S. patent application Ser. No. 498,841 discloses a prior art bill accepting device of such type. This prior art bill accepting device disclosed therein requires bifurcating passages for guiding a bill accepted by the bill discrimination device selectively to the escrow device or the stocker device and also requires switching means for switching a sort-out direction in the bifurcating passage. This necessitates the parallel arrangement of the escrow device and the stocker device along the two bifurcating passages resulting in a bulky structure of the vending machine as a whole. There is further the problem that an inaccurate switching control in the bifurcating passage may cause malfunction of the device.

It is, therefore, an object of the present invention to realize a compact design of the device and accuracy in the bill control by providing a novel bill accepting device capable of receiving a bill selectively in the escrow device or the stocker device without provision of the bifurcating passages.

In the construction in which both the escrow device and the stocker device are provided, a control operation is made such that inserted bills are normally received in the escrow device and received in the stocker device only when the escrow device has become full. Such a simple control, however, causes inconvenience in a case where bills of plural denominations are handled. Assume, for example, that inserted bills are received in the escrow device indiscriminately without considering the denomination. This will cause no inconvenience in a case where an inserted bill per se is automatically returned. If, however, a bill of a small denomination is to be paid out of the escrow device for change, this is impossible because bills of various denominations are received quite irregularly in the escrow device. Again, if an inserted bill is received in the stocker device unconditionally when the escrow device is full, there is no certainty as to what denomination of bill will be paid out of the escrow device in case the inserted bill is to be returned so that it is not possible to return accurately a bill of the same amount as the inserted bill.

It is, therefore, another object of the invention to provide a method for controlling accepting of bills enabling accepting and processing of bills of plural denominations without any inconvenience in a bill accepting device including a bill discrimination section for discriminating whether an inserted bill is true or not, an escrow section capable of retaining a bill in a state in which it can be automatically returned and a stocker section for retaining a bill in a state in which it cannot be automatically returned. More specifically, it is an object of the invention to automatically return a bill of the same denomination as the inserted bill whatever the denomination of the inserted bill may be and also to pay out a bill of a predetermined small denomination for change.

It is still another object of the invention to provide a bill accepting device capable of receiving a large number of bills and yet having a compact design.

THE SUMMARY OF THE INVENTION

The above primary object of the invention is attained by a bill accepting device characterized by comprising a stocker section between the bill discrimination section and the escrow section, this stocker section including a bill conveying passage connecting the bill discrimination section and the escrow section and a bill present in the bill conveying passage being received in a predetermined accumulating location in the stocker section by moving the bill in a direction in which the bill crosses the bill conveying passage. Owing to this construction, the bill discrimination section, the stocker section and the escrow section are arranged in a single row or line whereby a compact design of the device can be realized. By conveying the bill present in the bill conveying passage of the stocker section toward the escrow section or moving it in a direction in which it crosses the bill conveying passage, the bill can be received either in the escrow section or in the predetermined bill accumulation location in the stocker section so that a bifurcating passage for sorting out bills can be obviated. This reduces troubles which tend to occur in the bifurcating passage and thereby ensures an accurate bill control. In moving the bill to a predetermined accumulating location, the arrangement of moving it in a translational motion in a direction in which it crosses the bill conveying passage is advantageous in that a drive system for moving the bill and construction of the accumulating section can be simplified. The scope of the invention, however, is not limited to this but an arrangement may be made such that the bill will move in an arcuate motion as a window wiper of an automobile.

The above described other object of the invention is attained by a method for controlling accepting of bills characterized by receiving, if a bill of a predetermined small denomination has been inserted, the bill in said escrow section when the number of bills retained in the escrow section is below a predetermined number whereas receiving the bill in the bill accumulating section when the number of the retained bills is equal to or over the predetermined number, and stopping, if a bill of a denomination other than the predetermined small denomination has been inserted, the bill temporarily in a bill conveying passage and thereafter receiving the temporarily stopped bill in the bill accumulating section on condition that an article vending operation corresponding to the inserted bill has been started. Owing to this control method, only bills of a predetermined small denomination to be used for change are received in the escrow section. Accordingly, the bills retained in the escrow section can be paid out as change for a bill of a larger denomination. Further, since bills other than the predetermined small denomination bill, i.e., bills of larger denominations, are temporarily stopped in the bill conveying passage and thereafter is received in the bill accumulating section when the vending operation has been started, this temporarily stopped bill can be returned in the event that an inserted bill must be returned by operation of a return switch so that an inserted bill of a large denomination can be automatically returned by the bill of the same denomination. In the bill conveying passage, the bill can be fed forwardly or reversely or stopped. By stopping the inserted bill in the bill conveying passage, it can be automatically returned by feeding it reversely upon demand for return of it.

Instead of temporarily stopping a bill other than the predetermined small denomination bill (i.e., a bill of a large denomination) in the bill conveying passage, a single inserted bill of a large denomination may be temporarily retained in the escrow section and thereafter transferred from the escrow section to the bill accumulating section and stored therein when the vending operation has been started. Since the inserted bill of a large denomination which is temporarily retained in the escrow section is transferred to the bill accumulation section and received therein when the vending operation has been started and, on the other hand, this large denomination bill is automatically returned from the escrow section if a demand for return has been made, no large denomination bill is finally received in the escrow section but only the predetermined small denomination bill is received in the escrow section.

According to another aspect of the invention, there is provided a method for controlling accepting of bills in which, when a bill of a large denomination has been inserted in a bill accepting device capable of receiving only bills of a predetermined small denomination in the escrow section and paying out these small denomination bills for change, the inserted bill of a large denomination is received in the bill accumulating section if change for this inserted bill is payable by the number of the small denomination bills retained in the escrow section whereas the inserted bill of a large denomination is not accepted if such payment of change is not possible.

BRIEF DESCRIPTION OF THE DRAWINGS

In the accompanying drawings.

Figure 4:
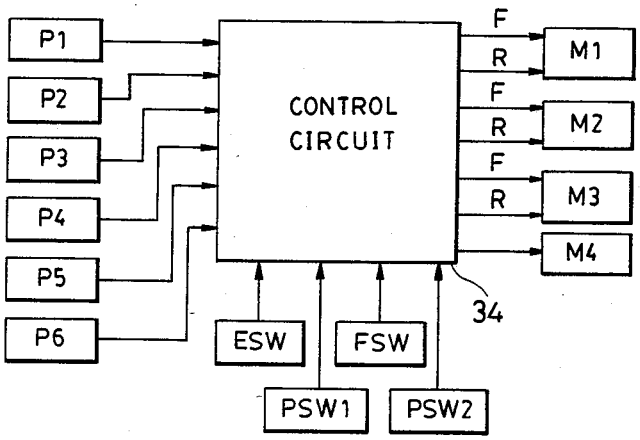
Figure 6:
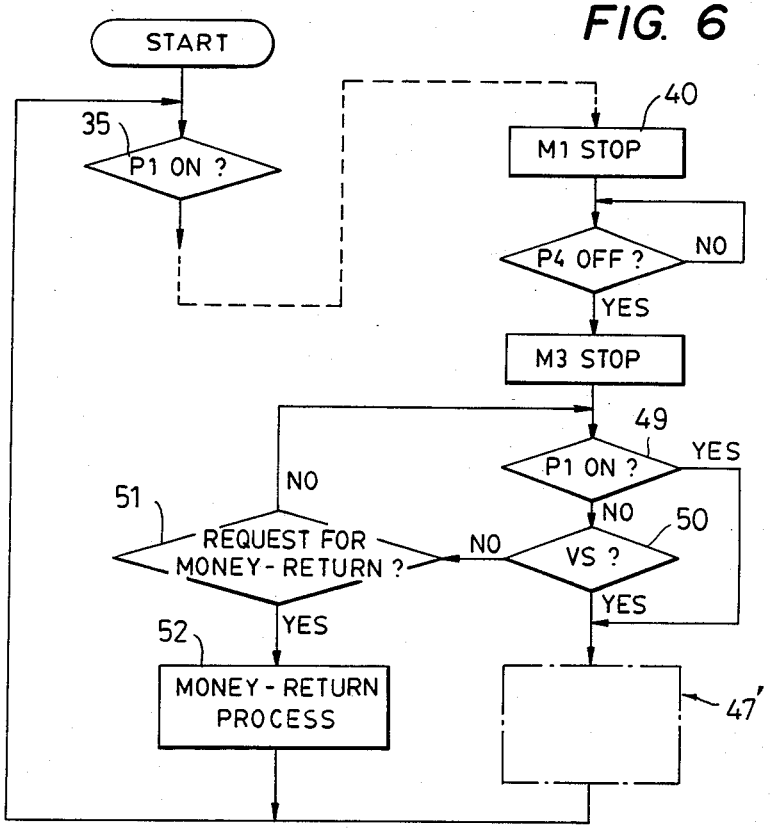
Figure 5:
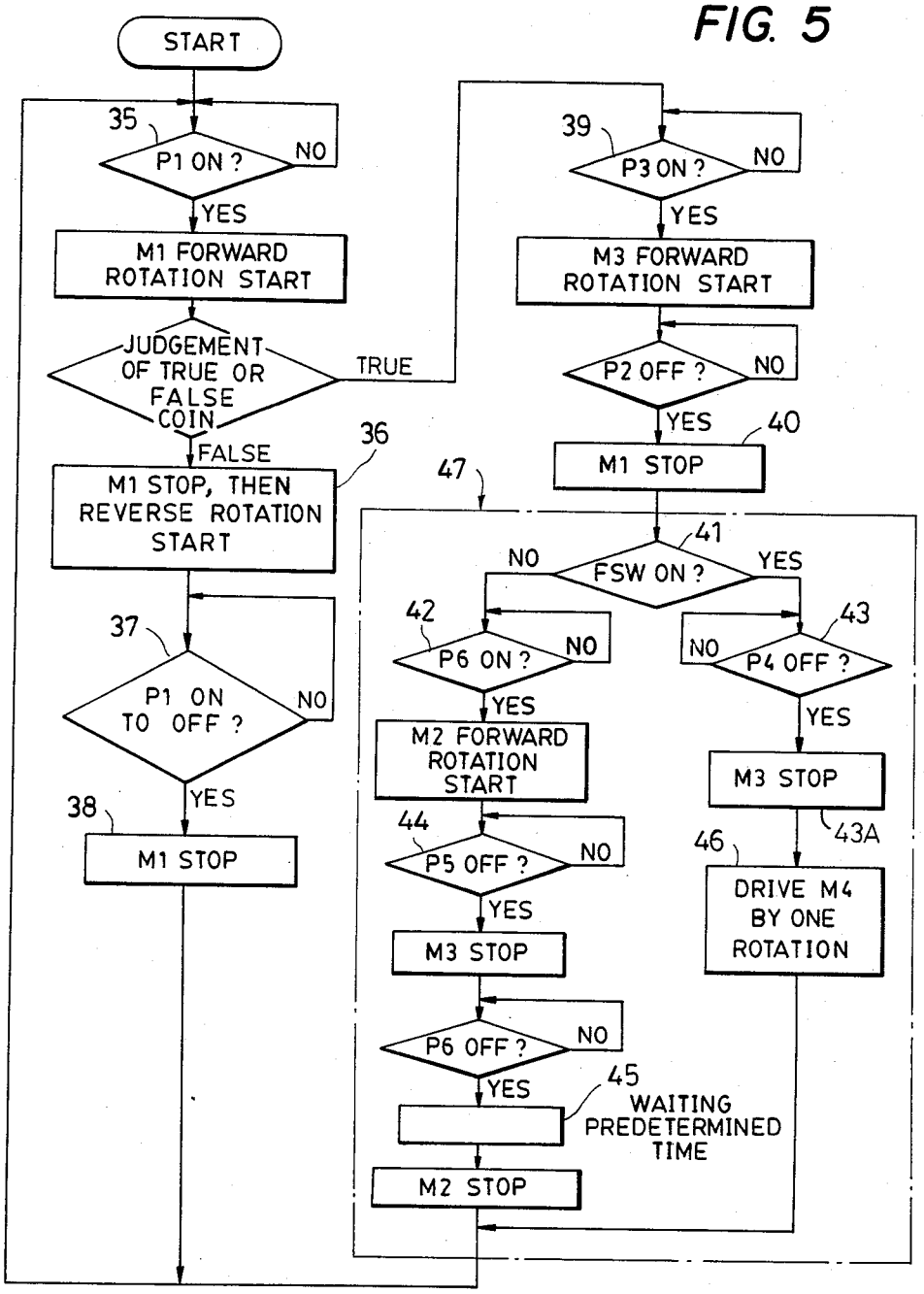
Figure 7:
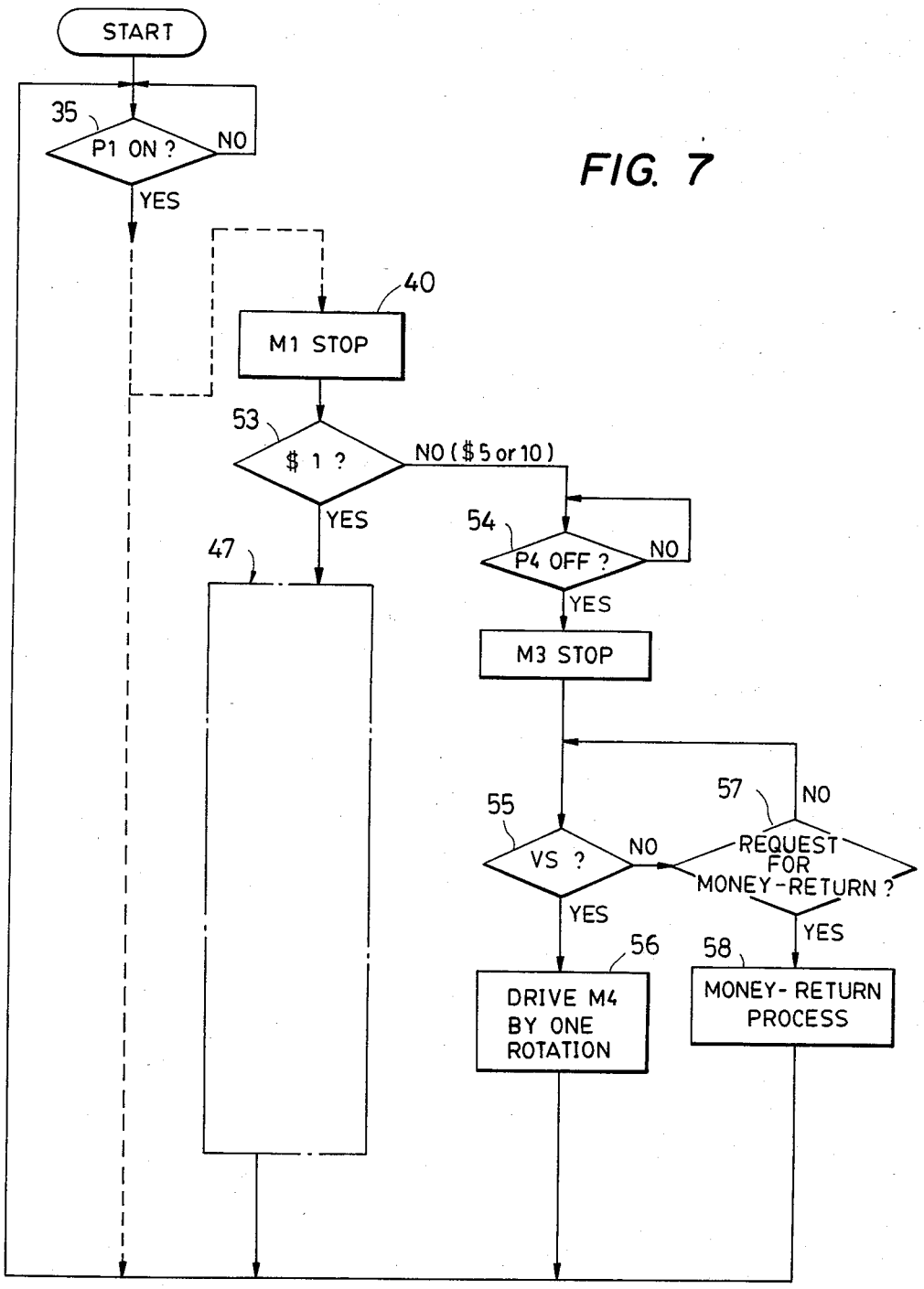
Figure 8:
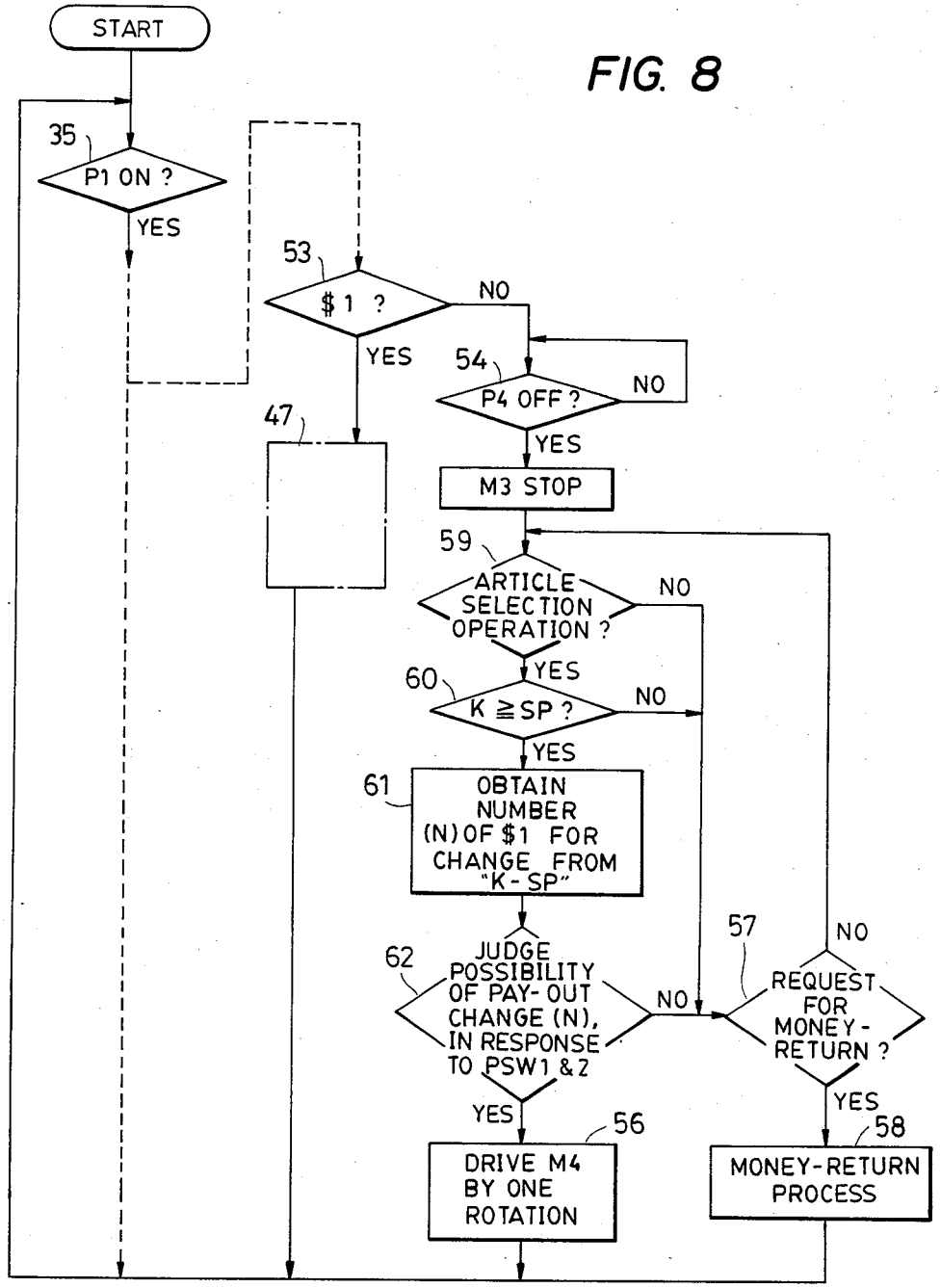
Figure 9:
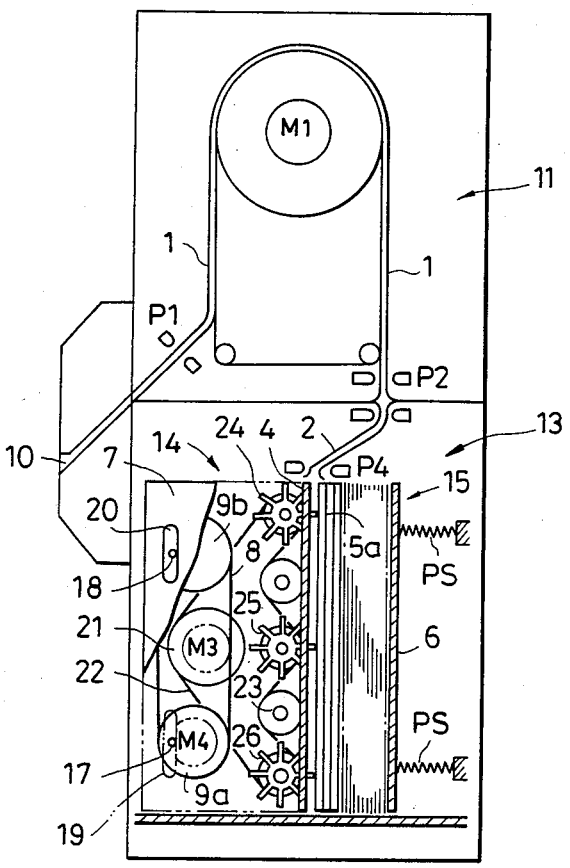

FIGS. *3a–3e* are schematic views showing the bill receiving operation of a stocker section in this embodiment;

FIG. 4 is a block diagram showing a control system in the same embodiment;

FIG. 5 is a flow chart showing an example of a control for accepting bills performed by the control circuit shown in FIG. 4;

FIG. 6 is a flow chart showing an example of a modified example of the control shown in FIG. 5;

FIG. 7 is a flow chart showing an example of an example of the control shown in FIG. 5 modified for controlling bills of plural denominations;

FIG. 8 is a flow chart showing a modified example of the control shown in FIG. 7; and FIG. 9 is a side sectional view of another embodiment of the bill accepting device.

DESCRIPTION OF PREFERRED EMBODIMENTS

Figure 1:
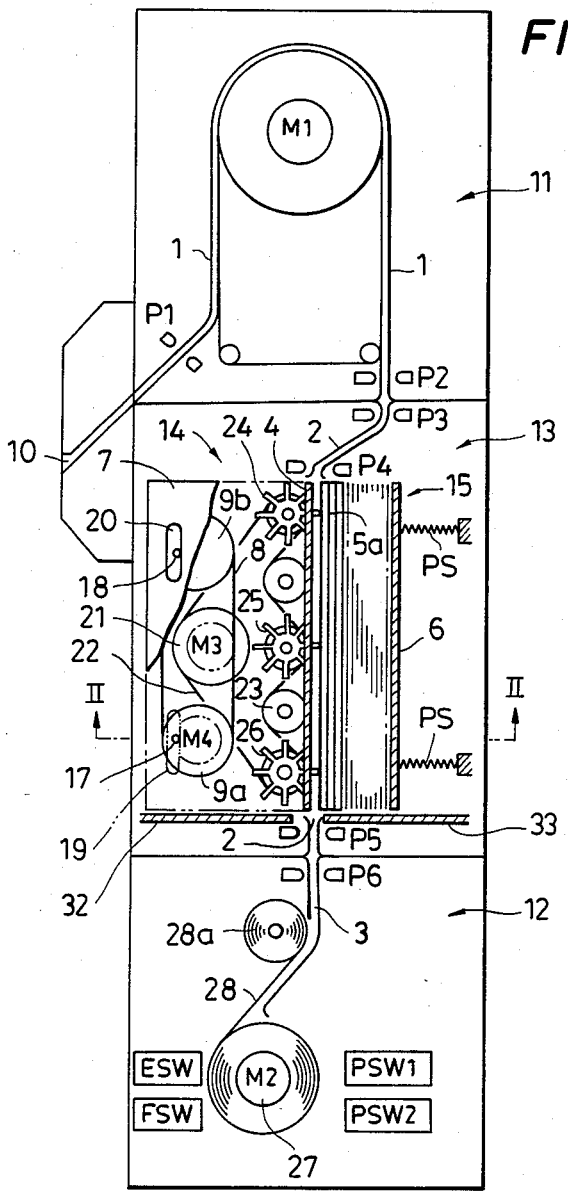
FIG. 1 is a side sectional view of an embodiment of a bill accepting device according to the invention.
Figure 2:
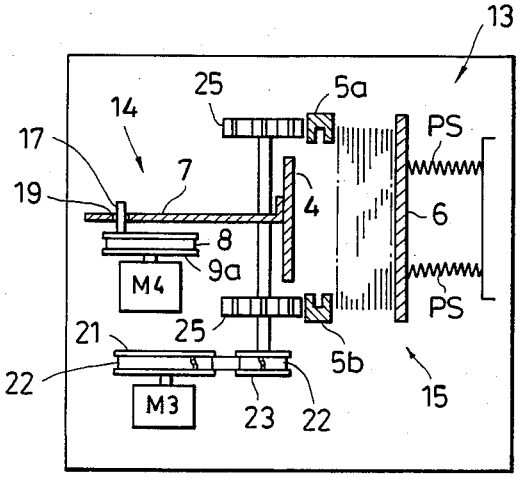
FIG. 2 is a sectional view of the bill accepting device of FIG. 1 taken along lines II—II.
Figure 3A:
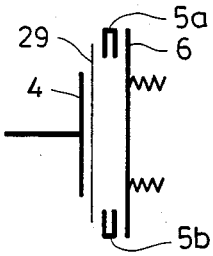
Figure 3B:
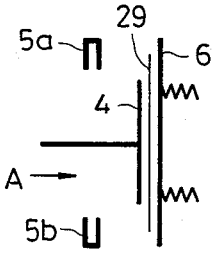
Figure 3C:
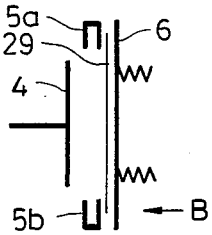
Figure 3D:
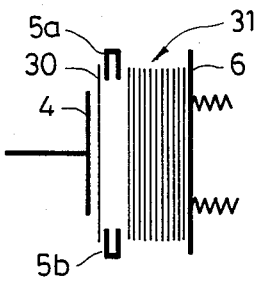
Figure 3E:
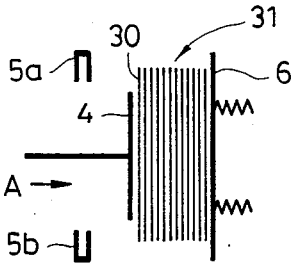

The bill accepting device according to the invention comprises a bill discrimination section 11 for discriminating a true bill from a counterfeit bill among bills which have been inserted from a bill insert slit 10, an escrow section 12 for temporarily retaining (i.e., retaining in a state where a bill can be automatically returned) a bill which has been judged to be a true bill by the discrimination section 11 and a stocker section 13 for receiving a once accepted bill in a state where it cannot be automatically returned. A bill passage 2 formed in the bill discrimination section 11, a bill passage 2 formed in the stocker section 13 and a bill passage 3 formed in the escrow section 12 are connected together in a single passage and no branch passage is provided. In FIG. 1, the bill passages 1 and 3 of the bill discrimination section 11 and the escrow section 12 and one side surface of a conveying device are shown schematically and the stocker section 13 is shown in a vertical section. In FIG. 2, the stocker section in its cross section taken along the lines II—II and viewed in the direction of arrows is shown in an enlarged scale.

A bill sensor P1 is provided in the vicinity of the inlet of the bill passage 1 in the bill discrimination section 11 and another bill sensor P2 is provided in the vicinity of the outlet of the bill passage 1. Other sensors for detecting whether a bill is a true one or a counterfeit one are also provided in the bill discrimination section 11. These sensors are not shown for they are not related to the subject matter of the present invention. By way of example, the bill accepting device is capable of accepting three denominations of bills, i.e., 10-dollar, 5-dollar and 1-dollar bills, and the bill discrimination section 11 is capable of discriminating a true bill from a counterfeit one with respect to these three denominations. The sensors P1 and P2 are respectively photo sensors each consisting of a pair of light-emitting and light receiving elements disposed across the passage 1. Sensors P3–P6 to be described later are of the same construction.

A bill conveying motor M1 in the bill discrimination section 11 controls feeding of bills in the discrimination section 11, conveying bills in the receiving direction (i.e., toward the stocker section 13) during a forward rotation and in a returning direction (toward the insert slit 10) during a reverse rotation. If the inserted bill has been judged true, it is accepted whereas if it has been judged false, it is returned.

The outlet of the passage 1 (on the side of the sensor P2) communicates with the bill passage 2 of the stocker section 13. The perpendicular portion of the bill passage 2 in the stocker section 13 is defined by a push plate 4 of a reciprocating device 14 and vertically elongated channel members *5a, 5b*. The length of the perpendicular portion is substantially equivalent to the longitudinal length of the bill. A bill sensor P3 is provided in the vicinity of the inlet of the bill passage 2 in the stocker section 13. Bill sensors P4 and P5 are also provided at the inlet and outlet of the perpendicular portion of the bill passage 2. The outlet of the passage 2 communicates with the bill passage 3 of the escrow section 12. A bill sensor P6 is provided in the vicinity of the inlet of the bill passage 3.

In the stocker section 13, there are provided the reciprocating device 14 and the bill conveying device one side of the perpendicular portion of the bill passage 2 and a bill accumulating section 15 on the other side of the perpendicular portion. The bill accumulating section 15 comprises a pair of vertically elongated channel members *5a* and *5b* which are perpendicularly disposed in parallel to each other with an interval which is slightly narrower than the transverse length of the bill and a bill compressing plate 6 which is of a transverse length slightly larger than the that of the bill and is disposed perpendicularly in parallel to the channel members 5*a* and 5*b*. While the channel members 5*a* and 5*b* are fixed, the bill compressing plate 6 is displaceable in the direction normal to the surface of the plate 6 and is constantly biased toward the channel members 5*a* and 5*b* by the action of compression springs PS or leaf spring or the like pressure imparting means provided at suitable locations.

The reciprocating device 14 comprises the push plate 4 which is substantially parallel to the bill compressing plate 6, a drive plate 7 fixed to the push plate 4 at a right angle thereto and a motor M4 and a drive force transmission means (a belt 8 and pulleys 9*a* and 9*b*) for driving the push plate 4 and the drive plate 7 in a reciprocating motion. In FIG. 1, only a fragmentary portion of the drive plate 7 is shown. The motor M4 is fixedly provided in a suitable location and its rotation is transmitted to the pulley 9*a* and further to the pulley 9*b* through the belt 8. The pulleys 9*a* and 9*b* are disposed in parallel to the push plate 7 with projections 17 and 18 provided on these pulleys being inserted in two slits 19 and 20 formed in the drive plate 7. As the pulleys 9*a* and 9*b* are rotated by the rotation of the motor M4, the projections 17 and 18 move in a circular motion, causing the drive plate 7 to reciprocate in the direction normal to the surface of the plate, i.e., to the left and right as viewed in FIG. 1, due to the engagement of the projections 17 and 18 with the slits 19 and 20. As the drive plate 7 is reciprocated, the push plate 4 is reciprocated in the direction normal to the surface of the drive plate 7 toward and away from the bill compressing plate 6. One rotation of the pulleys 9*a* and 9*b* causes one reciprocating motion of the drive plate 7 and the push plate 4. In a normal state, the push plate 4 is in the furthest position from the bill accumulating section 15 and the perpendicular portion of the bill passage 2 is defined between this push plate 4 and the channel members 5*a* and 5*b*.

The vertical length of the push plate 4 is substantially equivalent to the longitudinal length of the bill but the width of the push plate 4 is narrower than the transverse length of the bill and also narrower than the interval between the channel members 5*a* and 5*b*. When, accordingly, the push plate 4 is reciprocated toward and away from the bill accumulating section 15 by one rotation of the motor M4, the push plate 4 can pass through the interval between the channel members 5*a* and 5*b*.

In the stocker section 13, the bill conveying device comprises a motor M3, a pulley 21 to which the rotation of the motor M3 is transmitted, five pulleys (only one of them is designated by reference character 23) to which the rotation of the pulley 21 is transmitted through a belt 22 and three pairs of bill carrying rollers 24, 25 and 26 provided coaxially on three of the pulleys (23). The bill carrying rollers 25 consist of rollers which are made, e.g., of rubber and have projections along the periphery thereof. Referring to FIG. 2, the rollers 25 consist of a pair of rollers which are disposed with an interval therebetween being equivalent to the interval between the channel members 5*a* and 5*b*. The rotation of the motor M3 is transmitted to the five pulleys (23) through the pulley 21 and the belt 22 and then to the respective pairs of the bill carrying rollers 24–26 as rotation in the same direction through three of the pulleys (23). The bill is caught on both sides thereof between the bill carrying rollers 24–26 and the channel members 5*a* and 5*b* and carried by the rotation of the rollers 24–26. The motor M is rotatable in both directions so that the bill in the passage 2 can be carried either in the direction in which the bill is accepted or in the direction in which the bill is returned. By stopping the rotation of the motor M3, the bill can be temporarily stopped somewhere in the perpendicular portion of the passage 2 (i.e., before entering the escrow section 12 and the bill accumulating section 15).

In the escrow section 12, a helical spring 28 is fixed at an end thereof to a suitable location on a drum 27 which is rotated by the motor M2. The bill is held between a winding member using this drum 27 as its core and the spring 28 and wound tightly on the winding member. More specifically, the bill having entered the escrow section 12 after passing through the passage 2 in the stocker section 13 passes through the passage 3 and enters the space between the winding body having the drum 27 as the core and the spring 28. By a timely forward driving of the motor M2 (counterclockwise rotation as viewed in the figure), the spring 28 is wound on the drum 27 and the bill carried thereto is wound tightly with the spring 28. When it is necessary to pay out the bill wound on the drum 27 toward the passage 3, the motor M is rotated in the reverse direction. The spring 28 is wound on the core 28*a* by a self-restoring force by an amount corresponding to the reverse rotation of the motor M2 and the bill is delivered out toward the bill passage 3 accompanying the movements of the drum 27 and the spring 28.

In connection with the motor M2, an emptiness detector ESW, a fullness detector FSW, a first predetermined number detector PSW1 and a second predetermined number detector PSW2 are provided. When the motor M2 is in its initial position, i.e., no bill has yet been wound on the drum 27, the emptiness detector ESW is actuated to detect the empty state of the drum 27. When the motor M2 is rotated by a predetermined number of rotations from the initial position, the fullness detector FSW is actuated through a reduction gear mechanism (not shown) to detect the fullness of the drum 27. The detectors PSW1 and PSW2 are provided through a similar reduction gear mechanism. The detector PSW1 is turned on when the number of bills retained in the escrow section 12 is less than the first predetermined number whereas the detector PSW2 is turned on when the retained number is less than the second predetermined number. By way of example, the first predetermined number is "9" which is the number of maximum change for a 10-dollar bill against a 1-dollar bill and the second predetermined number is "4" which is the number of maximum change for a 5-dollar bill against a 1-dollar bill. The number of bill at which the fullness detector FSW is actuated may be set at any desired number (e.g., 10–40).

The bill which has been inserted through the bill insert slit 10 is led to the escrow section 12 through the passages 1 and 2 and temporarily retained in the escrow section 12. While the inserted bill is led to the escrow section 12, the reciprocating mechanism 14 in the stocker section 13 is not operated but the bill conveying device (motor M3 etc.) only is operated. The bill supplied from the bill discrimination section 11 therefore is led to the escrow section 12 through the passage 2 of the stocker section 13. The bill accumulating section 15 in the stocker section 13 receives the bill supplied from the bill discrimination section 11 or the bill paid out of the escrow section 12. The operation for receiving the bills in the bill accumulating section 15 of the stocker section 13 is performed in the following manner.

When a bill to be received is supplied from the bill discrimination section 11, the bill conveying motor M3 in the stocker section 13 is rotated in the forward direction to pull the bill into the perpendicular portion of the passage 2. When a bill to be received is supplied from the escrow section 12, the motor M3 is rotated in the reverse direction to pull the bill into the perpendicular portion. When the bill to be received has completely entered the perpendicular portion of the passage 2, i.e., the passage portion between the push plate 4 and the channel members 5*a* and 5*b*, the motor M is stopped thereby to stop the bill there. When the motor M is rotated forwardly, the complete entering of the bill into the passage 2 is known by ceasing of detection of the bill by the sensor P4 which has kept detecting it. When the motor M3 is rotated reversely, the complete entering is known by ceasing of detection of the bill by the sensor P5 which has kept detecting it. By rotating the motor M4 of the reciprocating device 14 by one rotation after stopping the motor M3, the bill which has temporarily been stopped in the perpendicular portion of the passage 2 is received in the bill accumulating section 15. This bill receiving operation is schematically shown in FIG. 3.

FIG. 3 is a schematic view corresponding to FIG. 2. (a) shows an initial state in which a bill 29 to be received is supplied to the perpendicular portion of the passage 2 when no bill is accumulated between the bill compression plate 6 and the channel members 5*a* and 5*b*. As the motor M4 is rotated by one rotation, the push plate 4 translates in the direction of the bill compression plate 6 (the direction of arrow A) in the stroke of 0°–180° thereby pushing the bill 29 in the passage 2 toward the compression plate 6. The pushed bill 29 passes through the channel members 5*a* and 5*b* with the push plate 4 in a flexed state and comes into abutting engagement with the compression plate 6. As shown in FIG. 3(*b*), the compression plate 6 and the bill 29 held between the push plate 4 and the compression plate 6 are moved in the direction of arrow A (in the direction for compressing the spring PS) against the force of the compression spring PS. As the motor M4 is rotated from 180° to 360°, the push plate 4 is moved in the opposite direction (the direction of arrow B) and the compression plate 6 and the bill 29 are returned with the push plate 4 by the restoring force of the compression spring PS. Upon abutting of the sides of the bill 29 against the channel members 5*a* and 5*b*, the movements of the bill 29 and the compression plate 6 are prevented by the channel members 5*a* and 5*b* and thereafter the push plate 4 only moves in response to the rotation of the motor M4, returning to the original position (i.e., the position in the perpendicular position of the passage 2) when one rotation of the motor M4 has been completed. This is one cycle of the bill receiving operation in the stocker section 13 and, as shown in FIG. 3(*c*), the bill 29 is finally received between the channel members 5*a* and 5*b* and the bill compression plate 6. The bill 29 is held tightly between the channel members 5*a* and 5*b* and the compression plate 6 by the force of the compression spring PS.

By repeating the above described one cycle of the bill receiving operation, a bill 30 (see FIG. 3(*d*)) to be received newly is added to bills 31 which have been accumulated between the compression plate 6 and the channel members 5*a* and 5*b*. More specifically, as shown in FIG. 3(*e*), the push plate 4 adds the new bill 30 to the bills 31 and pushes these bills 30 and 31 and the compression plate 6 together in the direction of the arrow A in the forward movement of the push plate 4. Then, as the push plate 4 moves back, the new bill 30 is held between the old bills 31 and the channel members 5*a* and 5*b*. In this manner, bills are stocked in the transverse direction in an upstanding state between the bill compression plate 6 and the channel members 5*a* and 5*b* and compressed and accumulated in this state.

In the reciprocating device 14, there may be provided a slide support base 32 (FIG. 1) for slidably supporting the drive plate 7 under the drive plate 7 or in other suitable location. Similarly, in the bill accumulating section 15, a base plate 33 (FIG. 1) may be provided under the bill accumulating location and the compression plate 6 to support the channel members 5*a* and 5*b* fixedly and also support the lower portions of the bills and the compression plate 6 movably.

For automatically returning a bill retained in the escrow section 12 toward the bill insert slit 10 (or paying it out as a part of change money as will be described later), the motors M2, M3 and M1 are rotated reversely to deliver out the bill through the passages 3, 2 and 1. For returning a bill being temporarily held in the perpendicular portion of the passage 2 toward the bill insert slit 10, the motors M3 and M1 are rotated reversely. For receiving a bill retained in the escrow section 12 in the bill accumulating section 15 in the stocker section 13, the motors M2 and M3 are rotated reversely until one bill has entered the perpendicular portion of the passage 2 in the stocker section 13 when the rotation of these motors is stopped and, thereafter, the reciprocating device 14 is operated to receive the bill in the bill accumulating section 15. Thus, bills retained in the escrow section 12 are transferred one by one to the bill accumulating section 15 of the stocker section 13 during the inventory operation. Control operations in receiving inserted bills in the escrow section 12 or the bill accumulating section 15 will be described below.

FIG. 4 is a block diagram showing the control system of the bill accepting device of FIG. 1. Outputs of the sensors P1–P6 and the detectors ESW, FSW, PSW1 and PSW2 are applied to a control circuit 34 and output of this control circuit is used for controlling driving of the motors M1–M4. The rotation of the motors M1–M3 is reversible but the motor M4 can rotate only in the forward direction. As to the sensors relating to the judgement of truth or falsehood of an inserted bill, illustration thereof is omitted. FIG. 5 which is a flow chart of the outline of the inserted bill controlling operation by the control circuit 34 shows, by way of example, a control operation performed in a case where the denomination of the bill usable in this bill accepting device is only one kind (i.e., 1-dollar bill).

In block 35, whether the sensor P1 is turned on or not is examined. It is assumed here that the on state of the sensors P1–P6 signifies a state in which a bill has been detected. Upon insertion of a bill into the bill insert slit 10, the sensor P1 is turned on. As the sensor P1 is turned on, the forward rotation of the motor M1 is started. The inserted bill is thereby carried through the passage 1. In the passage 1, whether the bill is true or not is judged and, if the bill has been judged to be a counterfeit bill, the motor M1 is once stopped and then rotated reversely until the sensor P1 has been turned off when the motor M1 is stopped (blocks 36, 37 and 38). The counterfeit bill thereby is brought back to the bill insert slit 10.

When the bill has been judged true, the control operation proceeds to block 39 where whether the sensor P3 is on or not is examined. If block 39 is YES, it signifies that the leading end of the inserted bill has entered the passage 2 of the stocker section 3 and, in response thereto, the forward rotation of the motor M3 is started. The forward rotation of the motors M1 and M3 causes the bill to be transferred from the discrimination section 1 to the stocker section 13. Upon passing of the rear end of the bill by the sensor P2, the sensor P2 is turned off and the motor M1 is stopped by processing of block 40. In block 41, whether the fullness detector FSW in the escrow section 12 is on (i.e., detecting the fullness) or not is examined. If block 41 is NO, block 42 and subsequent processings are performed to receive the bill in the escrow section 12, whereas if block 41 is YES, block 43 and subsequent processings are performed to receive the bill in the bill accumulating section 15 in the stocker section 13. This judgement in block 41 is accurately made in the course that the rear end of the bill is displaced from the location of the sensor P2 to the location of the sensor P4.

The route of NO in block 41 will be described first. As the bill is carried through the passage 2 by the forward rotation of the motor M3 and the leading end of the bill has entered the inlet of the passage 3 of the escrow section 12, the sensor P6 is turned on and the block 42 becomes YES. In response thereto, the forward rotation of the motor M2 is started. By the forward rotation of the motors M3 and M2, the bill is supplied from the passage 2 of the stocker section 13 to the space between the winding member of the drum 27 and the spring 28 through the passage 3 of the escrow section 12 and wound between the drum 27 and the spring 28. As the rear end of the bill has passed by the sensor P5, the sensor P5 is turned off and block 44 becomes YES thereby stopping the motor M3. As the rear end of the bill then has passed by the sensor P6, the sensor P6 is turned off and the motor M2 is stopped after setting a waiting time for a predetermined length of time in block 45. This waiting time is set to such time as will be required for the rear end of the bill to displace from the sensor P6 to the vicinity of the winding member of the drum 27.

The route of YES in block 41 will now be described. As the bill is carried through the passage 2 by the forward rotation of the motor M3 and the rear end of the bill has passed by the sensor P4, the sensor P4 is turned off and block 43 becomes YES. Thereupon the motor M3 is stopped by processing in block 43A. In this state, the inserted bill is located in a position in which it is in register with the push plate 4 and is at a standstill in this position. Then, in block 46, processing is made to rotate the motor M4 of the reciprocating device 14 by one rotation. The push plate 4 thereby effects one reciprocating motion as was described before, pushing the bill in the passage 2 toward the bill accumulating section 15 and thereby causing the bill to be received in the bill accumulating section 15.

As described above, if the number of bills retained in the escrow section 12 has not reached the predetermined full number, the inserted bill is immediately led to the escrow section 12, whereas if the number has already reached the fullness, the inserted bill is once stopped in the passage 2 of the stocker section 13 and thereafter is received in the bill accumulating section 15 by operating the reciprocating device 14.

FIG. 6 shows another system of accepting the inserted bill. The portion from block 35 to block 40 is the same as the equivalent portion in FIG. 5 so that illustration thereof is omitted. The portion of block 47' is also the same as block 47 in FIG. 5 so that illustration thereof is also omitted. In block 47', there are no processings of blocks 43 and 43A in block 47 and the processing shifts immediately from YES in block 41 to block 46. Further, in block 47', a processing of "motor M3 forward rotation start" is added between NO in block 41 and block 42 in block 47. In FIG. 5, the inserted bill is immediately received in the bill accumulating section 15 or the escrow section 12 depending upon whether the escrow section 12 is full or not. In FIG. 6, the inserted bill is temporarily stopped in the perpendicular portion in the passage 2 of the stocker section 13 and the bill in the passage 2 is received in the escrow section 12 or the accumulating section 15 only when a next bill has been inserted or a vending operation has been made. In FIG. 6, it is when the rear end of the bill has passed by the sensor P2 that the motor M1 is stopped by processing of block 40 and at this time the motor M3 is still continuing its forward rotation. When the rear end of the bill has passed by the sensor P4, the sensor P4 is turned off and block 48 becomes YES. In response thereto, the motor M3 is stopped. The bill is thereby stopped in a position in which it is in register with the push plate 4, i.e., the perpendicular portion of the passage 2. The bill waits in this state until a next bill is inserted or a vending operation is started.

In block 49, whether the sensor P1 is on or not is examined. When a next bill has been inserted in the bill insert slit 10, block 49 becomes YES and the processing jumps to block 47'. In block 50, whether the vending operation has started or not (whether a vend start signal VS has been generated or not) is examined. If block 50 is YES, the processing proceeds to block 47'. If both blocks 49 and 50 are NO, the processing returns to block 49 through block 51 and repeats the loop of blocks 49, 50 and 51. In block 51, whether a money return order has been generated or not is examined. If the money return order has been generated, the processing proceeds to block 52 where the money return operation is effected. The motors M3 and M1 are rotated reversely to return a bill in the passage 2 toward the bill insertion slit 10. If the money return order has not been given and a next bill has been inserted or the vending operation has been started, the processing proceeds to block 47' to receive the escrow section 12 or the bill accumulating section 15. That is, as described above, the processing for receiving the bill in either the escrow section 12 or the bill accumulating section 15 is performed in block 47' depending upon the state of the fullness detector FSW.

FIG. 7 shows an embodiment in which a control operation for bills of three denominations (e.g., 10-dollar, 5-dollar and 1-dollar bills) is performed. In the embodiment of FIG. 7, if a 1-dollar bill which is the bill of the smallest denomination is inserted, the 1-dollar bill is immediately received in the escrow section 12 unless the escrow section 12 is full, whereas it is received in the bill accumulating section 15 of the stocker section 13 when the escrow section 12 is full. In a case where a bill other than 1-dollar bill, i.e., a 10-dollar or 5-dollar bill, has been inserted, the inserted bill is temporarily stopped in the perpendicular section of the passage 2 in the stocker section 13 and thereafter is received in the bill accumulating section 15 on condition that the vending operation has been started. Accordingly, the escrow section 12 temporarily retains only a bill of a predetermined small denomination (1-dollar bill) and the bill accumulating section receives all bills of predetermined larger denominations (5-dollar and 10-dollar bills) and bills of the small denomination which have exceeded the number of bill retainable in the escrow section 12. Accordingly, when vending is made by inserting a bill of a larger denomination, payout of a bill of a small denomination as change can be easily made.

In FIG. 7, the portion from block 35 to block 40 is the same as the corresponding portion in FIG. 5 so that illustration thereof is omitted. Likewise, block 47 is the same as block 47 in FIG. 5 so that illustration of details thereof is omitted. It is when the rear end of the bill has passed by the sensor P2 that the motor M1 is stopped by processing in block 40 and the motor M3 is still continuing its forward rotation at this time. In block 53, whether the denomination of the inserted bill which has been judged true by the bill discrimination section 11 is 1-dollar (i.e., the predetermined small denomination bill to be received in the escrow section 12) or not is examined. If block 53 is YES, processing of block 47 is performed. If block 53 is NO, the processing proceeds to block 54. If block 53 is YES, i.e., a 1-dollar bill has been inserted, the same processing as was described before is made by the routine of block 47.

If the inserted bill is not a bill of the predetermined small denomination to be received in the escrow section 12, i.e., if the inserted bill is a 5-dollar or 10-dollar bill, block 53 is NO and the processing proceeds to block 54. When the judgement in block 53 is made, the motor M3 is still continuing its forward rotation. The inserted bill therefore is carried through the passage 2 until the rear end of the bill has passed by the sensor P4 when the sensor P4 is turned off and block 54 becomes YES. In response thereto the motor M3 is stopped. The bill thereby is stopped in a position in which it is in register with the push plate 4, i.e., the perpendicular portion of the passage 2. The bill waits unitl a next bill is inserted or the vending operation is started. In block 55, whether the vending operation has been started (whether the vend start signal VS has been generated) or not in examined. If block 55 is YES, the processing proceeds to block 56. If block 55 is NO, the processing is reversed to block 55 through block 57 and this loop is repeated. In block 57, whether the moeny return order has been generated or not is examined. If the money return order has been generated, the processing proceeds to block 58 where the money returning operation is performed. The motors M3 and M1 are rotated reversely to return the bill in the passage 2 toward the bill insertion slit 10. If no money return order has been given and a next bill has been inserted or the vending operation has been started, the processing proceeds to block 56 where the motor M4 is rotated by one rotation. This causes the push plate to move in one reciprocating motion as described before thereby pushing the bill temporarily held in the passage 2 toward the bill accumulating section 15 to be received therein.

As described above, inserted bills of denominations (5-dollar and 10-dollar) other than a predetermined small denomination (1-dollar) are temporarily stopped in the perpendicular portion of the passage 2 and thereafter are received in the bill accumulating section 15 on condition that the vending operation has been started.

In the embodiment of FIG. 7, states of the predetermined number detectors PSW1 and PSW2 of the escrow section 12 are not considered. If the control operation is performed taking into account the states of these detectors PSW1 and PSW2, inconvenience that a bill of a large denomination is received in the bill accumulating section 15 in a case where payout of change is not possible can be prevented. In FIG. 8, the portion from block 35 to block 47 is the same as the corresponding portion in FIG. 7 so that illustration thereof is omitted. In FIG. 8, the routine when block 53 is NO is different from that in FIG. 7.

When block 53 is NO, i.e., a 5-dollar or 10-dollar bill has been inserted, whether the sensor P4 is off or not is examined in block 54 in the same manner as in FIG. 7. As the sensor P4 is turned off, the motor M3 is stopped and the inserted bill is temporarily stopped in the perpendicular portion of the passage 2. In block 59, whether or not an article selection operation (selection switch operation) has been made in the vending machine in which this bill accepting device is provided is examined. If the selection operation has been made, amount K of the inserted bill (5 dollars or 10 dollars) is compared with a set vend price SP of the selected article (block 60) and, if "$K \geqq SP$", i.e., vending is possible, the processing proceeds to block 61. In block 61, the number N of the 1-dollar bill required for change is counted on the basis of the subtraction "K - SP". Nextly, in block 62, whether or not the number N of 1-dollar bill required for change can be paid by the present number of bills retained in the escrow section 12 is examined on the basis of outputs of the first predetermined number detector PSW1 which is turned on when the number of 1-dollar bill retained in the escrow section 12 is, for example, less than 9 and the second predetermined number detector PSW2 which is turned on when the number is, for example, less than 4. If, for example, the detector PSW1 is off, this state signifies that the number of retained bills is 9 or over and, accordingly, payment of change in 1-dollar bills is ensured if N is 9 or less. If the detector PSW1 is on and the detector PSW2 is off, this state signifies that the retained number is less than 9 and 4 or over and, accordingly, payment of change in 1-dollar bills is ensured if N is less than 9 and 4 or over. If the judgement that the change can be paid out has been made as a result of the above operation, the processing proceeds to block 56 where the motor M4 is rotated by one rotation to receive the bill which has been temporarily stopped in the passage 2 in the bill accumulating section 15. If payment of the change is not possible, the processing proceeds to block 57 where whether the money return order has been given (i.e., whether the money return button has been pushed) or not is examined. If block 57 is NO, the processing is reverted to block 58 where whether another article selection operation has been made or not is examined.

In FIGS. 7 and 8, when a bill of a large denomination is temporarily stopped in the passage 2, the motor M1 should not preferably be rotated forwardly even if a next bill has been inserted in the bill insert slit 10.

In FIGS. 7 and 8, if an inserted bill is a 1-dollar bill, it is not temporarily stopped in the passage 2 but is received in the escrow section 12 or the bill accumulating section 15 depending upon the state of the fullness detector FSW. An arrangement may, however, be made such that the 1-dollar bill is temporarily stopped in the passage 2 until a next bill has been inserted or a vending operation has been started and thereafter is received either in the escrow section 12 or the accumulating section 15.

For detecting the number of bills retained in the escrow section 12, the above described embodiments employ two detectors PSW1 and PSW2 which detect whether the number is less than two predetermined numbers or not. More than two of such detectors may be provided. Alternatively, a counter for upcounting and downcounting the number of bills which enters and leaves the escrow section 12 may be provided instead of the detectors.

In the examples of FIGS. 7 and 8, inserted 5-dollar and 10-dollar bills are temporarily stopped in the perpendicular portion of the bill passage 2. Alternatively, these bills may be temporarily retained in the escrow section 12. In this case, the 5-dollar and 10-dollar bills temporarily retained in the escrow section 12 may be received in the bill accumulating section 12 by delivering out one bill from the escrow section 12 by rotating the motor M2 reversely, stopping this bill in the perpendicular portion of the bill passage 2 and feeding the bill to the accumulating section 15 by one rotation of the motor M4. The construction of the bill accepting device is not limited to the one shown in FIGS. 1 and 2 but other construction may be adopted. Further, bills usable in this device are not limited to 1-dollar, 5-dollar and 10-dollar bills but may be of any denomination. Bills of large denominations which are not used as change are not limited to two denominations as in the above described embodiments but may be one denomination or three or more denominations.

In FIGS. 1 and 2, the constructions of the reciprocating device 14, the bill conveying device and the bill accumulating section 15 are not limited to those illustrated but any other construction that performs the same function may be employed. For instance, the bill accumulating section 15 may be provided obliquely and a bill in the perpendicular portion of the passage 2 may be pushed down toward the bill accumulating section 15 (in this case the bill moves not in a complete translational motion but in somewhat arcuate motion). In the above embodiments, in moving the bill in the perpendicular portion of the passage 2 toward the accumulating section 15, the bill is pushed by the push plate 4. This, however, may be substituted by a bill sucking device. Further, the bill discriminating section 11, stocker section 13 and escrow section 12 which are disposed vertically in the above embodiments may be disposed horizontally in a laid state. The stocker section 13 and the escrow section 12 may preferably be made detachable. By making the side plate of the stocker section 13 on the side of the accumulating section 15 openable, bills received in the accumulating section 15 can be easily collected.

It is also possible to construct the bill accepting device by the bill discriminating section 11 and the stocker section 13 only without providing the escrow section, as shown in FIG. 9. This construction is suited for a case where a change payout function is not required. Features of this construction are that a large number of bills can be vertically stored in a compact structure, bills can be transferred accurately and promptly by the reciprocating device 14 and pressure can be imparted accurately on the accumulated bills by the compression plate 6.

What is claimed is:

1. A bill accepting device comprising:

a bill discrimination section for discriminating whether an inserted bill is true or not;

an escrow section means for retaining a bill accepted by said bill discrimination section as a true bill and returning the retained bill via a bill conveying passage; and a stocker section provided between said bill discrimination section and said escrow section means, said bill conveying passage being included in said stocker section and connecting said bill discrimination section and said escrow section means, said stocker section receiving a bill present in said bill conveying passage at a predetermined accumulating location by moving said bill in a direction in which said bill crosses said bill conveying passage.

2. A bill accepting device as defined in claim 1 wherein said bill conveying passage in said stocker section comprises a linear portion corresponding at least to the longitudinal length of the bill and the receiving of a bill is effected by displacing a bill in said linear portion in a translational motion in the direction in which the bill crosses said passage.

3. A bill accepting device as defined in claim 1 wherein said stocker section comprises:

a bill conveying drive means provided in connection with said bill conveying passage;

a bill moving means for moving the bill in said bill conveying passage in a translational motion in a direction in which the bill crosses said passage; and an accumulating device for accumulating bills having been moved by said bill moving means.

4. A bill accepting device as defined in claim 3 wherein said moving device comprises a push plate having a width narrower than the transverse length of the bill, normally forming a part of one wall surface of said bill conveying passage and being capable of moving in a translational motion in a direction crossing said bill conveying passage and reciprocating means for enabling said push plate to reciprocate by a predetermined distance across said passage; and said accumulating device comprises a bill receiving member forming a part of the other wall surface of said bill conveying passage and having an opening of such dimensions as are narrower than the transverse length of the bill and allow passing of said push plate therethrough and a compression plate to which a pressing force is applied elastically in the direction of said bill receiving member, and accumulates the bill between said compression plate and said bill receiving member, said bill being pushed by said push plate in accordance with one reciprocating movement of said push plate and passed through the opening of said bill receiving member with said push plate.

5. A bill accepting device as defined in claim 1 which further comprises control means for performing control as to which of said escrow section means and said bill accumulating location of said stocker section should receive a bill having been accepted as a true bill by said bill discrimination section.

6. A bill accepting device as defined in claim 5 wherein said control means effects a control operation such that the bill having been accepted by said bill discrimination section is led to said escrow section means passing through said bill conveying passage of said stocker section when the number of bills retained in said escrow section means has not reached a predetermined number whereas the bill having been accepted by said bill discrimination section is stopped in said bill conveying passage in said stocker section and then received in said accumulating location in said stocker section when the number of bills retained in said escrow section means has reached the predetermined number.

7. A bill accepting device as defined in claim 5 wherein said control means effects a control operation such that the bill having been accepted by said bill discrimination section is temporarily stopped in said bill conveying passage in said stocker section and thereafter is received in either said escrow section means or said accumulating location of said stocker section on condition that a new bill has been inserted or a vending operation has been started.

8. A method for controlling accepting of bills in a bill accepting device including a bill discrimination section for discriminating whether an inserted bill is true or not and accepting a true bill, an escrow section capable of retaining a plurality of bill accepted by said bill discrimination section and automatically returning the retained bill and a bill accumulating section for accumulating the bills accepted by said bill discrimination section, said method comprising:

receiving, if a bill of a predetermined small denomination has been inserted, said bill in said escrow section when the number of bills retained in said escrow section is below a predetermined number whereas receiving said bill in said bill accumulating section when the number of the retained bills is equal to or over said predetermined number; and stopping, if a bill of a denomination other than said predetermined small denomination has been inserted, said bill temporarily in a bill conveying passage and thereafter receiving said temporarily stopped bill in said bill accumulating section on condition that an article vending operation corresponding to the inserted bill has been started.

9. A method for controlling accepting of bills in a bill accepting device including a bill discrimination section for discriminating whether an inserted bill is true or not and accepting a true bill, an escrow section capable of retaining a plurality of bills accepted by said bill discrimination section and automatically returning the retained bill and a bill accumulating section for accumulating the bills accepted by said bill discrimination section, said method comprising:

receiving, if a bill of a predetermined small denomination has been inserted, said bill in said escrow section when the number of bills retained in said escrow section is below a predetermined number whereas receiving said bill in said bill accumulating section when the number of the retained bills is equal to or over said predetermined number; and retaining, if a bill of a denomination other than said predetermined small denomination has been inserted, said bill temporarily in said escrow section and thereafter receiving said temporarily retained bill in said bill accumulating section on condition that an article vending operation corresponding to the inserted bill has been started.

10. A method for controlling accepting of bills in a bill accepting device including a bill discrimination section for discriminating whether an inserted bill is true or not and accepting a true bill, an escrow section capable of retaining a plurality of bill accepted by said bill discrimination section and automatically returning the retained bill, a bill accumulating section for accumulating the bills accepted by said bill discrimination section and detection means for detecting the number of bills retained in said escrow section, said method comprising:

receiving, if a bill of a predetermined small denomination has been inserted, said bill in said escrow section when the number of bills retained in said escrow section is below a predetermined number representing fullness whereas receiving said bill in said bill accumulating section when the number of the retained bills is equal to or over said predetermined number representing fullness; and stopping, if a bill of a denomination other than said predetermined small denomination has been inserted, said bill temporarily in said bill conveying passage and thereafter receiving said temporarily stopped bill in said bill accumulating section on condition that it has been judged possible to pay out change corresponding to the inserted bill by the bills retained in said escrow section in response to the output of said detection means and an article selection operation.

11. A bill accepting device comprising:

a bill discrimination section for discriminating whether an inserted bill is true or not;

a bill conveying passage including a linear portion corresponding at least to the longitudinal length of the bill and receiving the inserted bill having passed through said bill discrimination section in said linear portion;

a push plate having a width narrower than the transverse length of the bill, normally forming a part of one wall surface of said linear portion of said bill conveying passage and being capable of moving in a translational motion crossing said bill conveying passage;

reciprocating means for enabling said push plate to reciprocate by a predetermined distance across said passage;

a bill receiving member forming a part of the other wall surface of said linear portion of said bill conveying passage and having an opening of such dimensions as are narrower than the transverse length of the bill and allow passing of said push plate therethrough; and a compression plate to which a pressing force is applied elastically in the direction of said bill receiving member, said bill being pushed by said push plate in accordance with one reciprocating movement of said push plate, passed through the opening of said bill receiving member with said push plate and accumulated between said compression plate and said bill receiving member.

* * * * *